US008451140B2

(12) United States Patent
Piccinini et al.

(10) Patent No.: US 8,451,140 B2
(45) Date of Patent: May 28, 2013

(54) MONITORING ROAD SURFACE CONDITIONS

(75) Inventors: Sandro Piccinini, Rome (IT); Luigi Pichetti, Rome (IT); Marco Secchi, Rome (IT); Antonio Secomandi, Milano (IT); Amr F. Yassin, Cairo (EG); Mohamed Zakaria, Nasr (EG)

(73) Assignee: International Business Machines Corporation, Armonk, NY (US)

( * ) Notice: Subject to any disclaimer, the term of this patent is extended or adjusted under 35 U.S.C. 154(b) by 298 days.

(21) Appl. No.: 12/336,735

(22) Filed: Dec. 17, 2008

(65) Prior Publication Data

US 2009/0160675 A1 Jun. 25, 2009

(30) Foreign Application Priority Data

Dec. 20, 2007 (EP) ..... 07123770

(51) Int. Cl.
*G08G 1/09* (2006.01)

(52) U.S. Cl.
USPC ..... 340/905; 340/901; 340/539.13; 701/117

(58) Field of Classification Search
USPC ..... 340/905, 539.13, 901; 701/117
See application file for complete search history.

(56) References Cited

U.S. PATENT DOCUMENTS

| | | | | | |
|---|---|---|---|---|---|
| 4,921,468 | A * | 5/1990 | Miwa | 398/106 |
| 4,930,084 | A | 5/1990 | Hosaka et al. | |
| 5,076,384 | A * | 12/1991 | Wada et al. | 180/169 |
| 5,610,821 | A | 3/1997 | Gazis et al. | |
| 5,678,847 | A | 10/1997 | Izawa et al. | |
| 6,064,931 | A | 5/2000 | Sawada et al. | |
| 6,161,071 | A * | 12/2000 | Shuman et al. | 701/48 |
| 6,694,239 | B1 | 2/2004 | Yao et al. | |
| 7,369,941 | B2 * | 5/2008 | Schiffmann et al. | 701/301 |
| 7,382,274 | B1 * | 6/2008 | Kermani et al. | 340/901 |
| 7,421,334 | B2 * | 9/2008 | Dahlgren et al. | 701/117 |
| 2004/0107042 | A1 * | 6/2004 | Seick | 701/117 |
| 2006/0226611 | A1 * | 10/2006 | Xiao et al. | 280/5.514 |
| 2007/0168092 | A1 * | 7/2007 | Knox et al. | 701/37 |
| 2008/0015743 | A1 * | 1/2008 | Haug | 701/1 |
| 2009/0012688 | A1 * | 1/2009 | Hattori et al. | 701/79 |

* cited by examiner

*Primary Examiner* — George Bugg
*Assistant Examiner* — Naomi Small
(74) *Attorney, Agent, or Firm* — Yee & Associates, P.C.; David A. Mims, Jr.

(57) ABSTRACT

Monitoring road surface conditions using a mobile computer unit carried by a vehicle operating on a road network and adapted to detect information about the road surface conditions. The detection may be done by means of bump sensors which may also provide information on the size and the depth of the bump according to a detected shock with respect to the vehicle speed. Such information may then be transmitted to a central controller server. The central server may use the collected information for several purposes, such as help in planning maintenance of the road network; forwarded to users and vehicles for journey planning purposes; and to deviate traffic in case of extreme surface damage.

20 Claims, 7 Drawing Sheets

MONITORING ROAD SURFACE CONDITIONS

CROSS REFERENCE TO RELATED APPLICATIONS

This application claims priority to French Foreign Patent Application Serial No. 07123770.5 entitled "METHOD AND SYSTEM FOR MONITORING ROAD SURFACE CONDITIONS", filed on Dec. 20, 2007, and claiming the same priority date, which is incorporated herein by reference.

FIELD OF THE INVENTION

The present invention relates to the information technology field. More specifically, the invention relates to a method and system for monitoring road surface conditions and for reducing the effects of damaged or uneven road surfaces on vehicles.

BACKGROUND ART

Road maintenance is an increasingly complex and expensive activity. The consequences of a bad road maintenance range from possible traffic jams with related loss of time and increased pollution, to car damages (e.g. vehicle suspension systems and even to liability of the local Authorities for inefficient road maintenance. Normal wear and tear of road network can be forecasted in advance and properly monitored to guarantee a minimum standard level. However, extreme conditions (of weather and traffic) can cause unexpected road damages which are difficult to be monitored. On the other hand, a permanent and ad-hoc monitoring system would be highly expensive. An improved system which is able to assist the traffic and the maintenance of the road networks, without requiring a new dedicated infrastructure, would therefore be highly desirable.

It is an object of the present invention to alleviate the drawback of the prior art.

SUMMARY

According to an embodiment of the present invention there is provided a method of monitoring the surface of a road network, the method including the steps of: a mobile computer unit being associated to a vehicle operating on the road network, monitoring the road surface during the vehicle operation; responsive to a bump on the road surface being detected by the mobile computer unit determining the position of the vehicle at the moment the bump is detected; and receiving information of the detected bump and the determined position of the vehicle.

Another aspect of the present invention provides a computer program product stored on a computer readable media for monitoring the surface of a road network.

A still further aspect of the present invention provides a system including means for monitoring the surface of a road network.

A still further aspect of the present invention provides mobile unit adapted to be carried by a vehicle operating on the road network and adapted to be used in a system for monitoring the road network surface.

BRIEF DESCRIPTION OF THE DRAWINGS

The invention itself, as well as further features and the advantages thereof, will be best understood with reference to the following detailed description, given purely by way of a non-restrictive indication, to be read in conjunction with the accompanying drawings, in which.

DETAILED DESCRIPTION

One of the advantages of the method and system according to a preferred embodiment of the present invention is that existing structures are exploited without the need of building a dedicated, complex and expensive infrastructure. Navigation systems have become increasingly popular in recent years. A typical navigation system consists of a small electronic device that aids a driver of a vehicle to reach a desired destination. Navigation systems operate by knowing where the navigation unit is positioned by using Global Positioning Satellites (GPS) and by applying that position to a context provided by a map and by a desired destination. The navigation system can suggest how the driver of a vehicle (for example) should operate the vehicle (e.g. turn right in 500 metres) to get to the desired destination according to possible route alternatives (defined in the map) and personal preferences (e.g. avoiding motorways). The context can be augmented using additional information such as broadcasts of traffic information (traffic jams on certain routes). One prior art reference discloses a system for determining optimal vehicle routes using current traffic flow information. That system receives current traffic flow information from a number of individual vehicles and uses this information to identify when a traffic flow problem exists. Once the system has identified that a traffic problem exists, it re-calculates a new route based on the information received from the vehicles. The system therefore continuously monitors the traffic flow of a road network and provides alternative routes when traffic flow problems are identified. According to embodiments of the present invention, these existing structures may be exploited to implement a monitoring system which is able to determine the road surface conditions and to help planning the necessary maintenance.

Figure 1:
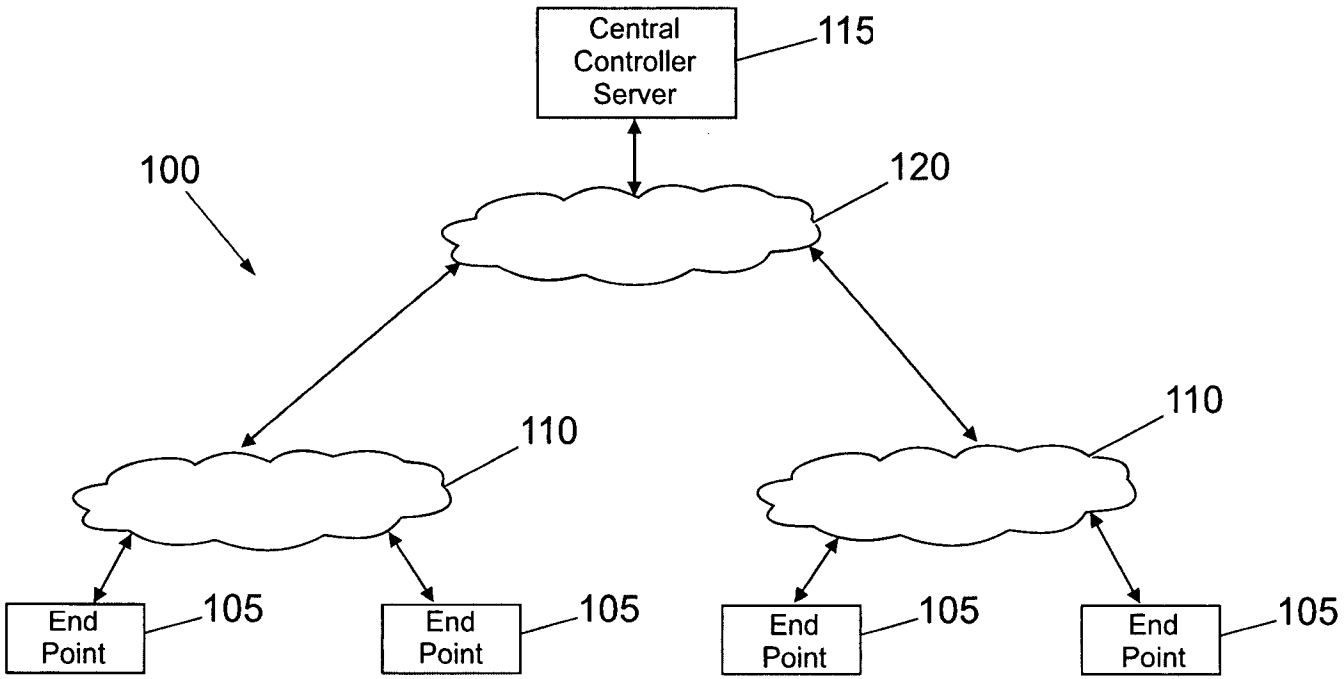
FIG. 1 is a schematic block diagram of the system in which the method of an embodiment of the invention is applicable.

With reference in particular to FIG. 1, a data processing system 100 with distributed architecture implementing a Navigation System, according to a preferred embodiment of the present invention is depicted. The system 100 includes multiple endpoints 105, which may be grouped into different subsets. The endpoints 105 can be mobile computer units, vehicle units and more generally any kind of data processing system capable of receiving and/or sending signal from/to a Central Controller Server 115. The endpoints 105 are connected to the Central Controller Server 115 through wireless networks 110-120 (for example GSM or GPRS network). The Central Controller Server 115 maintains a repository where traffic data maps and routes are collected and managed. Endpoints 105 are carried, for example, by vehicles circulating, for example operating, on the road network and are adapted to detect information about the road surface conditions. The detection may be done for example by means of bump sensors which may also provide information on the size and the depth of the bump according to the detected shock with respect to the vehicle speed. It is to be noted that these kinds of shock detectors (bump sensors) are often installed on vehicles and are normally used to adjust the active suspension system of the vehicle. According to a preferred embodiment of the present invention, such information may then be transmitted to the Central Controller Server 115; however other solutions are possible: as an example the information could be stored in a memory within the endpoint 105 for later collection and transmission to the Central Controller Server. A possible implementation which does not require a permanent connection between the endpoints 105 and the Central Controller Server 115 is a radio transmitter, similar to those used for paying tolls on Italian motor ways (known as Telepass®), which communicates with predetermined fixed receivers: these receivers may be placed for example at the end of a road to gain information on the surface conditions of that specific road. Another implementation may use RFID transmitters and receivers. Furthermore, a plurality of vehicles used for monitoring the road network may belong to an organization (e.g. Police cars, public transports, taxis); in such case another possible implementation would be a sort of black box which stores all information about the location (e.g. with GPS equipment) and the "intensity" of the detected bump, for later reuse. Also the use which the Central Controller Server can make of the collected information has many possible variations: it may help in planning maintenance of the road network; it may be forwarded to users and vehicles for journey planning purposes; it may be used to deviate traffic in case of extreme surface damages. In a preferred embodiment of the present invention information transmitted from endpoints 105 to Central Server 115 includes the detection of the bump and the location where the bump is detected, the location being determined by the Navigation System (e.g. through GPS) or any other means suitable to determine the position of the vehicle carrying the endpoint 105. Information can be more comprehensive and may include the size and the depth of the detected bump using a bump sensor for example, the speed of the vehicle when the detection has been made and many other possible data collected with vehicle equipment or dedicated sensors suitable for acquiring vehicle or location information. As mentioned above the preferred embodiments of the present invention may exploit the functionalities already available in vehicles to avoid the needs of large development effort and expense to implement the system, however many additional equipment might be added and used to collect information, e.g. cameras, video cameras, microphones, and any kind of sensors suitable for collecting road and vehicle information. Also it should be noted that a threshold in the intensity of the detected shock may be set, in order to avoid transmitting information for negligible irregularities of the road or the vehicle.

Figure 2:
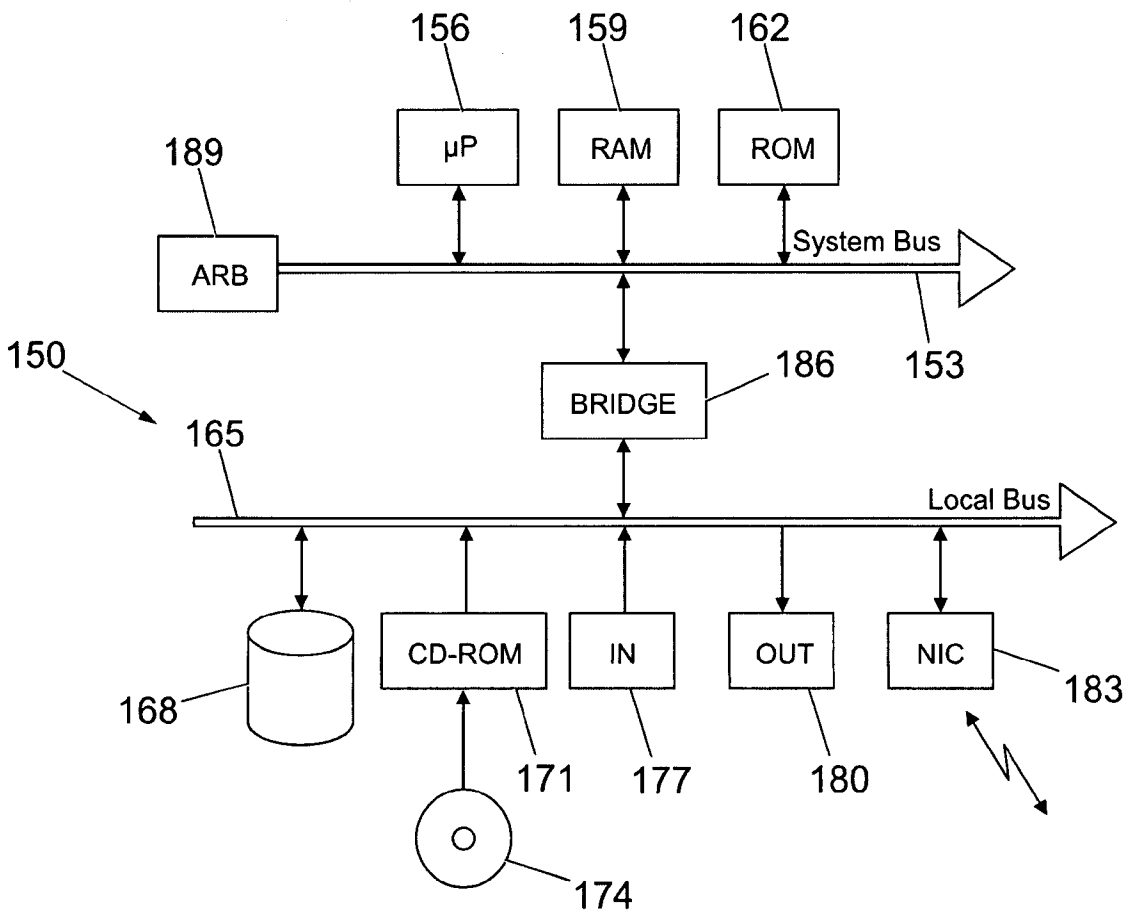
FIG. 2 shows the functional blocks of a generic computer system in which the embodiment of the invention described in FIG. 1 may be practiced.

As shown in FIG. 2, a generic computer of the system (e.g. mobile computer unit, central server, router, transmitter) is denoted with 150. The computer 150 is formed by several units that are connected in parallel to a system bus 153. In detail, one or more microprocessors (mP) 156 control operation of the computer 150; a RAM 159 is directly used as a working memory by the microprocessors 156, and a ROM 162 stores basic code for a bootstrap of the computer 150. Peripheral units are clustered around a local bus 165 (by means of respective interfaces). Particularly, a mass memory consists of a hard-disk 168 and a drive 171 for reading CD-ROMs 174. Moreover, the computer 150 includes input devices 177 (for example, a keyboard and a mouse), and output devices 180 (for example, a monitor and a printer). A Network Interface Card (NIC) 183 is used to connect the computer 150 to the network. A bridge unit 186 interfaces the system bus 153 with the local bus 165. Each microprocessor 156 and the bridge unit 186 can operate as master agents requesting an access to the system bus 153 for transmitting information. An arbiter 189 manages the granting of the access with mutual exclusion to the system bus 153.

Similar considerations apply if the system has a different topology, or it is based on other networks. Alternatively, the computers have a different structure, include equivalent units, or consist of other data processing entities (such as PDAs, mobile phones, and the like). In any case, an embodiment of the invention is also suitable to be used in a system wherein the control of workstations is decentralised, or even in a stand-alone computer. For example, in a in-vehicle satellite navigation system.

Figure 3:
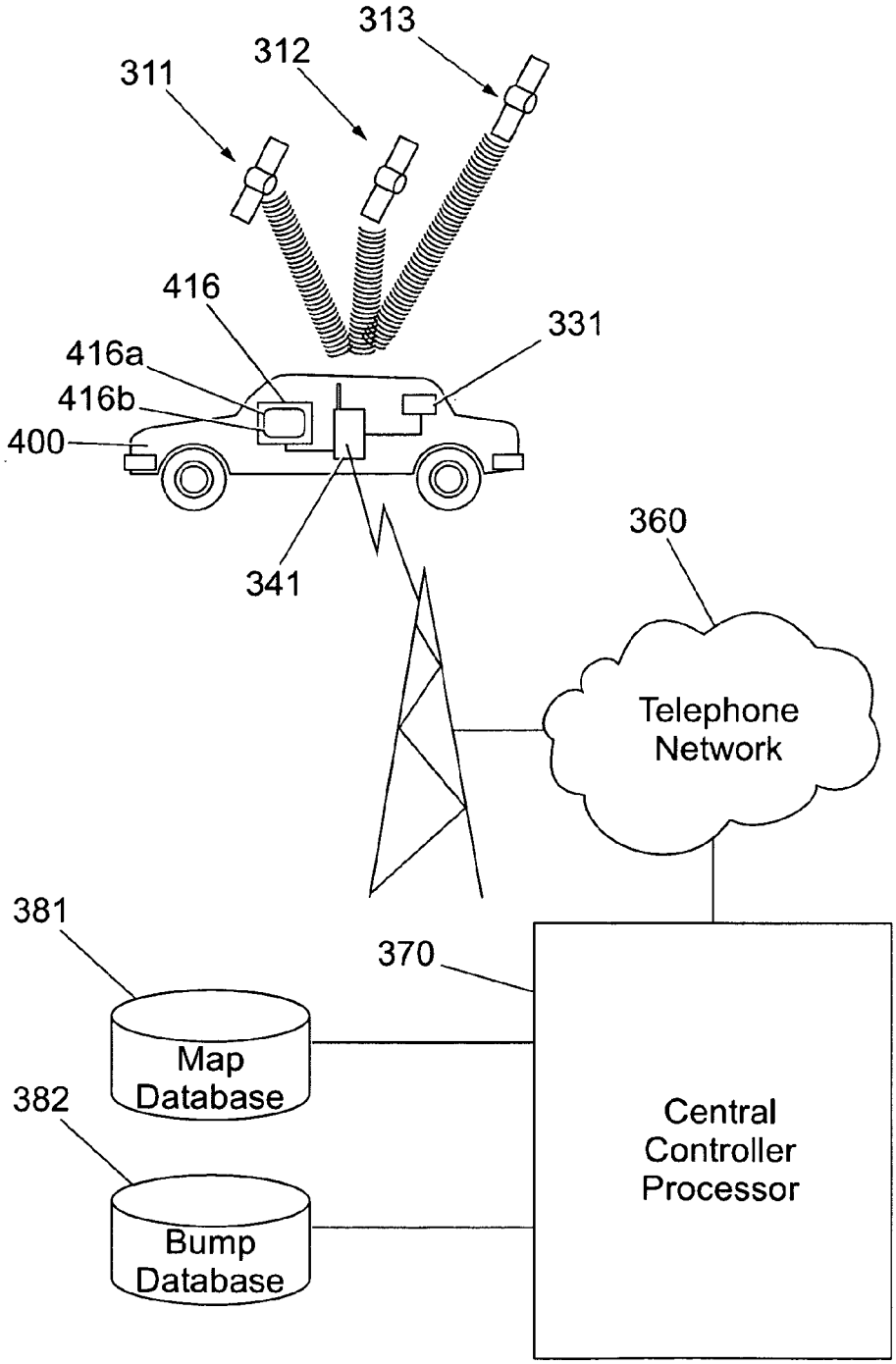
FIG. 3 shows a system suitable for implementing an embodiment the present invention.

FIG. 3 shows a system suitable for implementing an embodiment of the present invention. As shown in FIG. 3, there is provided a constellation of navigation satellites 311, 312 and 313 belonging for example to the GPS or Galileo systems. There is further provided a vehicle 400 carrying a navigation system 416. The navigation system includes a mobile computer unit 416*a* which includes a sensor interface 416*b*, a satellite positioning receiver 331 and cellular communication device 341. The sensor interface 416*b* receives input by the shock detectors, and other possible sensors which are installed in the vehicle 400. The satellite positioning receiver 331 receives timing data transmitted by the navigation satellites 311, 312 and 313 and thereby determines the instantaneous position of the vehicle 400. There is further provided a cellular telephone network 360, which is capable of bi-directional communication with the cellular communication device 341. There is further provided a Central Controller Processor 370, connected to the cellular telephone network 360 as well as a map database 381 and a bump database 382. Central Controller Processor 370, map database 381 and bump database 382 are included in Central Controller Server described in FIG. 1. As mentioned above, the telephone network solution is only one of the several possible implementation of the present invention.

The system typically works by a sensor in the vehicle 400 detecting a bump; such information is collected by the vehicle's computer unit 416*a*. The satellite positioning receiver 331 processes signals received from the navigation satellites 311, 312 and 313 so as to determine the position of the vehicle 400. The cellular communication device 341 is used to transmit the combined information (e.g. detection of bump and position of the vehicle) from the mobile computer unit 416*a* to the Central Controller Processor 370 by means of the cellular telephone network 360. Upon receiving at least a present position and detection of bump, the navigation processor 370 updates the bump database with reference to the map database 381. This new information can then be used in several ways, as described above.

Figure 4:
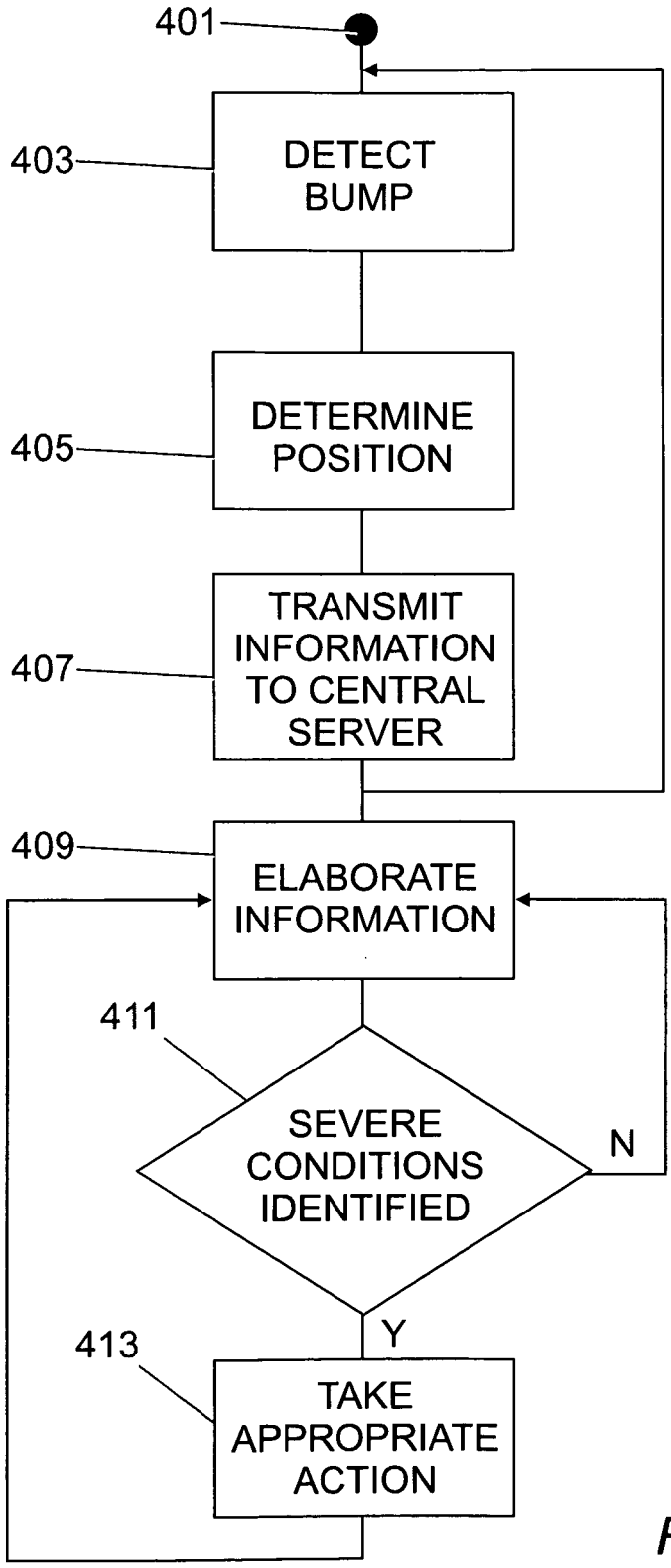
FIG. 4 shows a diagram describing the flow of activities relating to an illustrative implementation according to an embodiment of the invention.

With reference to FIG. 4, the logic flow of monitoring road surface according to an embodiment of the invention is illustrated. The method begins at the start circle 401. Continuing to block 403 the endpoint 105 (see FIG. 1) detects the bump. As explained above this detection can be done in several ways, e.g. by using a shock sensor mounted on a vehicle carrying the endpoint 105. The endpoint then determines the position of the bump, for example, by means of a GPS system of the vehicle (step 405) and transmits the information to the Central Controller Server 115 (step 407). As discussed this transmission can be done immediately by means of, for example, a mobile telephone line such as GSM network, or alternatively collected within the endpoint and then transferred at a later time. In any case, the steps of detecting the bump and determining the position may be repeated any time a bump is detected. The Central Server will put together all information received to build a map of possible bumps or road roughness (step 409). When the system identifies a possible dangerous or severe condition (step 411) an appropriate action is taken at step 413. The range of possible actions, as discussed, can be extremely wide, ranging from simply advising vehicle operators and users, to planning road maintenance actions, or even applying some corrective measures to vehicle equipment to react to the detected road conditions. Also the thresholds for considering a condition "severe" can be adjusted.

Figure 5:
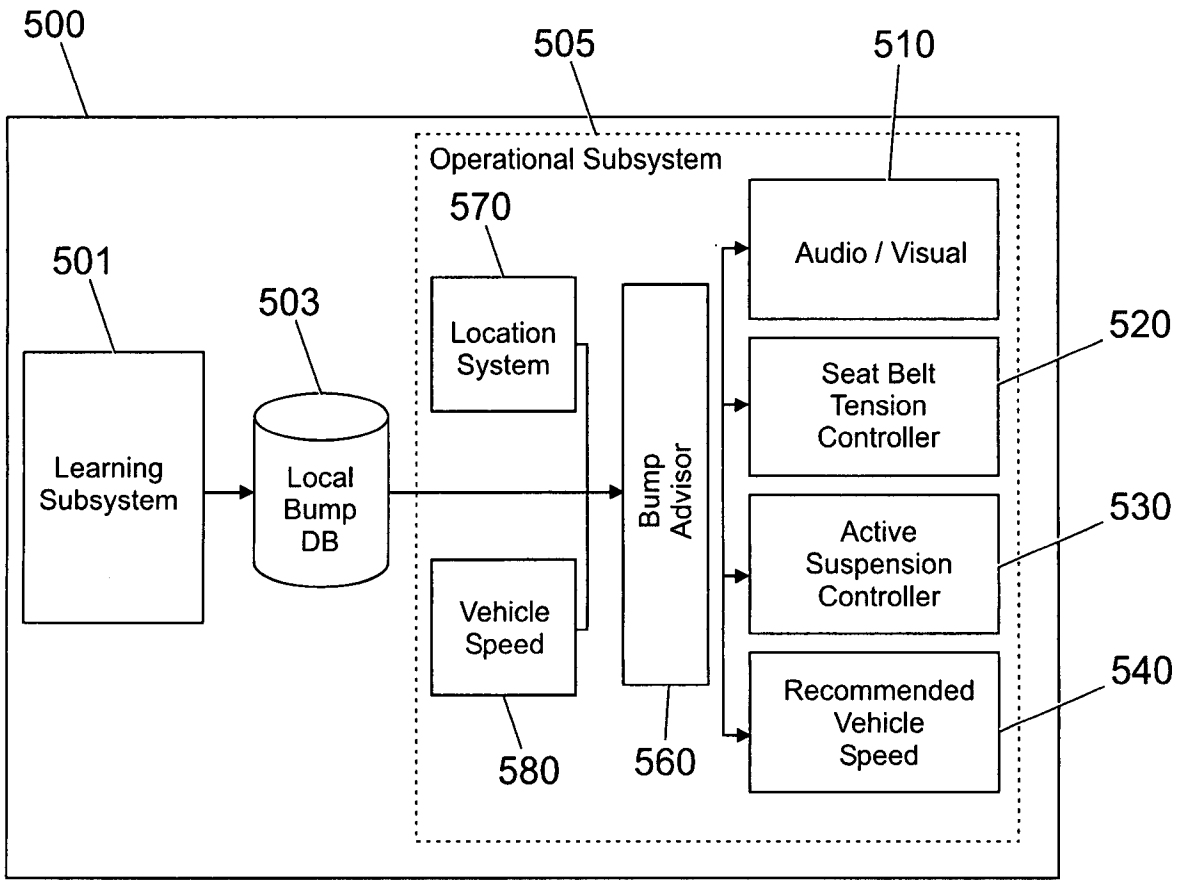
FIGS. 5, 6 and 7 show illustrative implementation of embodiments of the present invention.

FIG. 5 represents a possible further implementation of the method and system of the present invention. The system 500 includes the Learning Subsystem 501 which basically corresponds to the system described above for collecting information about bumps on the road and more generally on the conditions of the road network. The Learning Subsystem 501 is responsible for storing/updating data relating to e.g. road conditions, locations of detected bumps, bumps characteristics (e.g. width, length), other available lanes, road type (e.g. paved, unpaved, gravel road). Such information is then transmitted to a Local Bump Database 503 which may be stored on a vehicle. The database 503 provides the necessary information to the Operational Subsystem 505 which exploits the information about the road conditions to adjust some setting in the vehicle equipment. The Operational Subsystem 505 includes also a system 570 which provides information on the current location of the vehicle (e.g. a GPS navigator) and a speed meter 580. The Bump Advisor component 560 may be a core processing unit of the Operational Subsystem 505: it receives input from the Local Bump Database 503, the Location System 570 and the Vehicle Speed meter 580. All input are analyzed and processed to provide the necessary control input to a series of equipment, including a Seat Belt Tension Controller 520 which adjusts the tension of seat belts if the road is severely damaged, an Active Suspension Controller 530 which finds the best setting of the suspension system according to the road surface, a Recommended Vehicle Speed controller 540 which limits the maximum speed in case of difficult road conditions. An Audio/Visual interface 510 is used to communicate information to the driver. Those skilled in the art will appreciate that the above examples are only a selection of possible uses and implementations of the preset invention.

Figure 6:
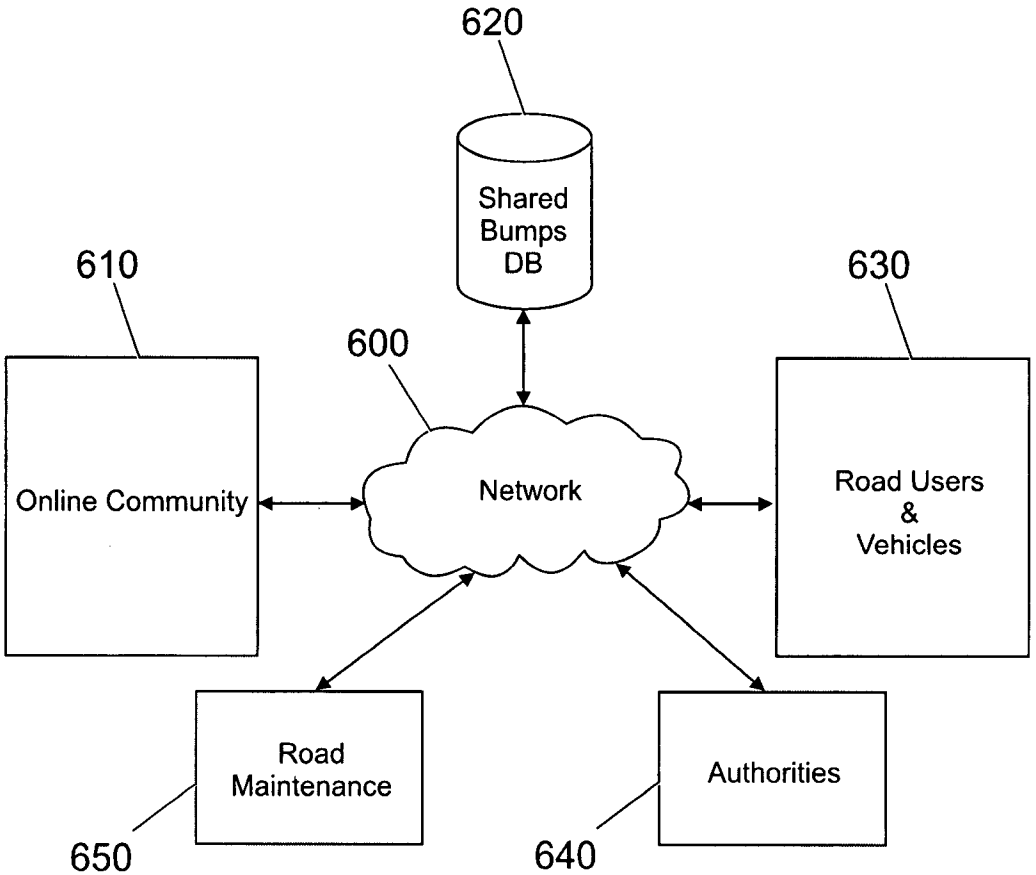

FIG. 6 provides a further example of implementation of the method and system of the present invention. A shared Bump Database 620 containing up to date information on Road conditions is accessible through a network 600 (e.g. Internet) by several possible users. Some examples include an Online Community 610 which can navigate the DB for research purposes, Road Users 630 as discussed above, Authorities 640 (e.g. Governmental or Local bodies) and Road Maintenance organizations 650.

Figure 7:
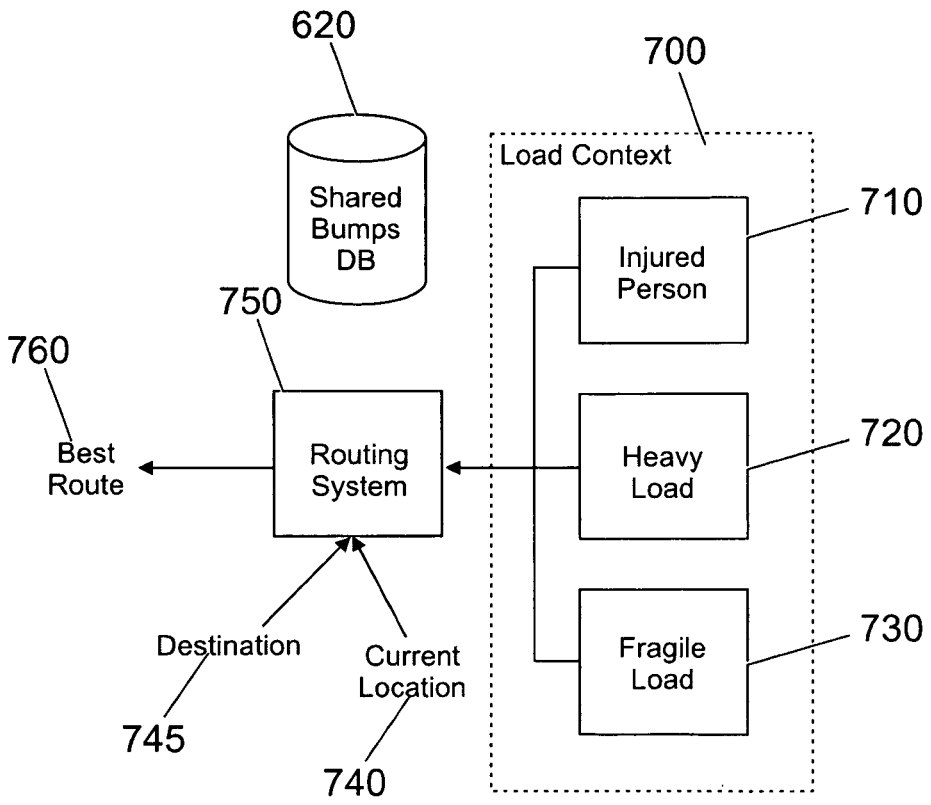

FIG. 7 illustrates another possible application which takes into consideration the kind of vehicle using the information. According to the carried "load" (e.g. Injured Person for an ambulance 710, Heavy Load for a Truck 720 or Fragile Load 730), a Routing System 750 may combine information from the Shared Bump Database 620 and from the navigator system of the vehicle (e.g. Current Location 740 and final Destination 745) and provides a customized Best Route 760 which will be dependent on the kind of load of the vehicle.

Embodiments of the invention can take the form of an entirely hardware embodiment, an entirely software embodiment or an embodiment containing both hardware and software elements. In a preferred embodiment, the invention may include but is not limited to firmware, resident software, microcode, etc.

Furthermore, embodiments of the invention can take the form of a computer program product accessible from a computer-usable or computer-readable medium providing program code for use by or in connection with a computer or any instruction execution system. For the purposes of this description, a computer-usable or computer readable medium can be any apparatus that can contain, store, communicate, propagate, or transport the program for use by or in connection with the instruction execution system, apparatus, or device.

The medium can be an electronic, magnetic, optical, electromagnetic, infrared, or semiconductor system, (or apparatus or device) or a propagation medium. Examples of a computer-readable medium include a semiconductor or solid state memory, magnetic tape, a removable computer diskette, a random access memory (RAM), a read-only memory (ROM), a rigid magnetic disk and an optical disk. Current examples of optical disks include compact disk-read only memory (CD-ROM), compact disk-read/write (CD-R/W) and DVD.

A data processing system suitable for storing and/or executing program code will include at least one processor coupled directly or indirectly to memory elements through a system bus. The memory elements can include local memory employed during actual execution of the program code, bulk storage, and cache memories which provide temporary storage of at least some program code in order to reduce the number of times code must be retrieved from bulk storage during execution.

Input/output or I/O devices (including but not limited to keyboards, displays, pointing devices, etc.) can be coupled to the system either directly or through intervening I/O controllers.

Network adapters may also be coupled to the system to enable the data processing system to become coupled to other data processing systems or remote printers or storage devices through intervening private or public networks. Modems, cable modem and Ethernet cards are just a few of the currently available types of network adapters.

The description of the present invention has been presented for purposes of illustration and description but is not intended to exhaust or limit the invention in the form disclosed. Many modifications and variations will be apparent to those of ordinary skill in the art. The embodiments were chosen and described in order to best explain the principles of the invention and the practical application, and to enable others of ordinary skill in the art to understand the invention for various embodiments with various modifications as are suited to the particular use contemplated.

While the invention has been particularly shown and described with reference to a preferred embodiment, it will be understood that various changes in form and detail may be made therein without departing from the spirit and scope of the invention.

The invention claimed is:

1. A method of monitoring a road surface of a road network, the method comprising:

associating a mobile computer unit with a vehicle operating on said road network, wherein the mobile computer unit is onboard the vehicle and interfaced with a cellular communication device providing bidirectional communication over a cellular communication network, the mobile computer unit interfaced with sensors comprising at least one shock sensor;

monitoring the road surface using said at least one shock sensor of the mobile computer unit during said vehicle operation so as to detect a bump, a bump intensity, and one of a bump width, length, or depth;

determining a position of the vehicle using GPS positioning data in response to detecting a bump on the road surface;

associating the position of the vehicle with a detected bump on the road surface;

providing information associated with the detected bump, the bump intensity, one of a bump width, length, or depth, and the determined position of the vehicle to a predetermined fixed receiver positioned proximate to a road of the road network to store in a shared database automatically accessible by the mobile computer unit of other vehicles operated by other users, wherein the information is processed to provide information representative of a condition of the road surface; and automatically adjusting adjustable equipment of vehicles having access to the shared database for the condition of the road surface at the determined position using an analysis of processed information stored on the shared database and a determined condition of the road surface, comprising at least one of adjusting a setting for the suspension system and adjusting a setting for tension of a seat belt according to the determined condition of the road surface at the determined position.

2. The method of claim 1, wherein the step of providing information creates received information, and further comprising:

storing the received information;

determining a relevance of the detected bump for said road network; and determining a recovery action in response to said relevance of the detected bump for said road network.

3. The method of claim 2 wherein the recovery action includes planning road maintenance according to the stored information.

4. The method of claim 2 wherein the recovery action includes a server transmitting to a plurality of vehicles the stored information.

5. The method of claim 1 wherein the mobile computer unit collects additional information about intensity of the detected bump, and further comprising a server receiving said additional information.

6. The method of claim 1 wherein the mobile computer unit collects information about a speed of the vehicle at a moment of detection of the bump.

7. The method of claim 4 wherein the vehicle includes at least one equipment adapted to react to the stored information, the at least one equipment adjusting its setting in order to minimize an effect of the bump on vehicle users.

8. The method of claim 7 wherein the at least one equipment includes one of an active suspension controller, a speed controller, and seat belt tension controller.

9. The method of claim 1 wherein receiving information of the detected bump and the determined position of the vehicle is performed each time a bump is detected.

10. The method of claim 1 wherein the information on the detected bump and the determined position of the vehicle is collected and stored within the mobile computer unit and is transmitted to a server at a later moment.

11. The method of claim 1 wherein the information on the detected bump and the determined position of the vehicle is received by predetermined fixed receivers that communicate with the vehicle.

12. The method of claim 1 wherein the information on the detected bump and the determined position of the vehicle is received by radio communication with the vehicle.

13. The method of claim 1 wherein the information on the detected bump and the determined position of the vehicle is received by a mobile telephone network.

14. A computer program product for monitoring a road surface of a road network, the computer program product comprising:

computer readable code stored in a computer readable tangible media, said computer readable code including computer instructions which when executed by a computer perform steps of:

associating a mobile computer unit with a vehicle operating on said road network, wherein the mobile computer unit is onboard the vehicle and interfaced with a cellular communication device providing bidirectional communication over a cellular communication network, the mobile computer unit interfaced with sensors comprising at least one shock sensor;

monitoring the road surface using the at least one shock sensor of said mobile computer unit during said vehicle operation, so as to detect a bump, a bump intensity, and one of a bump width, length, or depth;

determining a position of the vehicle using GPS positioning data from an onboard navigation system of the vehicle, in response to detecting a bump on the road surface;

associating the position of the vehicle with a detected bump on the road surface;

providing information of the detected bump, bump intensity, one of a bump width, length, or depth, and the determined position of the vehicle to a predetermined fixed receiver positioned proximate to a road of the road network to store in a shared database automatically accessible by the mobile computer unit of other vehicles operated by other users, wherein the information is processed to provide information representative of a condition of the road surface; and automatically adjusting adjustable equipment of vehicles having access to the shared database for the condition of the road surface at the determined position using an analysis of processed information stored on the shared database and a determined condition of the road surface, comprising at least one of adjusting a setting for the suspension system and adjusting a setting for tension of a seat belt according to the determined condition of the road surface at the determined position.

15. A system for monitoring a road surface of a road network, the system comprising:

a mobile computer unit, the mobile computer unit interfaced with a cellular communication device providing bidirectional communication over a cellular communication network and interfaced with sensors including at least one shock sensor, wherein the mobile computer unit is associated with a vehicle operating on said road network, wherein the mobile computer unit is onboard the vehicle;

the mobile computer unit monitoring the road surface using the at least one shock sensor of said mobile computer during said vehicle operation, the at least one shock sensor configured to detect a bump, a bump intensity, and one of a bump width, length, or depth;

a position location system determining a position of the vehicle in response to detecting a bump on the road surface using GPS positioning data from an onboard navigation system of the vehicle;

the mobile computer unit associating the position of the vehicle with a detected bump on the road surface;

a server for providing information of the detected bump, bump intensity, one of a bump width, length, or depth, and the determined position of the vehicle to a predetermined fixed receiver positioned proximate to a road of the road network to store in a shared database automatically accessible by the mobile computer unit of other vehicles operated by other users, wherein the information is processed to provide information representative of a condition of the road surface; and equipment of the other vehicles having access to the shared database with a capability to automatically adjust for the condition of the road at the determined position using an analysis of processed information stored on the database and a determined condition of the road surface, at least one of adjusting a setting for a suspension system and adjusting a setting for tension of a seat belt for the determined condition of the road surface at the determined location.

16. The method of claim 4 further comprising providing information for deviating traffic in case of damage to the road network so as to avoid a damaged area of the road network.

17. The method of claim 1 further comprising providing information to the receiver through RFID.

18. The method of claim 4 further comprising providing traffic information to a vehicle onboard navigation system.

19. The method of claim 4 further comprising providing traffic information to a police car.

20. A computer program product for monitoring a road surface of a road network, the computer program product comprising:

computer readable code stored in a computer readable tangible media, said computer readable code including computer instructions which, when executed by a computer, perform steps of:

associating a mobile computer unit with a vehicle operating on said road network, wherein the mobile computer unit is onboard the vehicle, the mobile computer unit comprising an interface with at least one shock sensor;

monitoring the road surface using the at least one shock sensor of said mobile computer unit during said vehicle operation, so as to detect a bump, a bump intensity, and one of a bump width, length, or depth;

determining a position of the vehicle using GPS positioning data from an onboard navigation system of the vehicle, in response to detecting a bump on the road surface;

associating the position of the vehicle with a detected bump on the road surface;

providing information of the detected bump, bump intensity, one of a bump width, length, or depth, and the determined position of the vehicle to a predetermined fixed receiver positioned proximate to a road of the road network, wherein the information provides road information representative of a condition of the road surface;

receiving the road information comprising information representative of the condition of the road surface from a server transmitting the road information to a plurality of vehicles; and determining a best route to a destination taking into account a load carried by the vehicle and the road information received from the server.

* * * * *